US005216781A

United States Patent [19]

Brondfield

[11] Patent Number: 5,216,781

[45] Date of Patent: Jun. 8, 1993

[54] OPERATING APPARATUS FOR CASEMENT WINDOWS

[76] Inventor: Gary N. Brondfield, 26500 Hendon Rd., Beachwood, Ohio 44122

[21] Appl. No.: 794,730

[22] Filed: Nov. 15, 1991

[51] Int. Cl.[5] ..... E05F 11/00

[52] U.S. Cl. ..... 16/114 R; 16/121

[58] Field of Search ..... 16/114 R, 118, 121; 81/3.4, 121.1, 124.4, 124.5, 177.1, 177.5, 177.85, 180.1, 489, 185, DIG. 11; 408/239 A; 49/324

[56] References Cited

U.S. PATENT DOCUMENTS

| | | | |
|---|---|---|---|
| Re. 251 | 11/1853 | Laird . | |
| 1,829,371 | 10/1931 | Ross . | |
| 1,878,569 | 9/1932 | Zolleis . | |
| 1,936,109 | 11/1933 | Frank | 287/53 |
| 2,047,703 | 7/1936 | Podolsky | 287/53 |
| 3,250,148 | 5/1966 | Soles | 74/548 |
| 3,313,057 | 4/1967 | Leddy | 16/121 |
| 3,386,306 | 6/1968 | Kenyon | 74/548 |
| 3,582,116 | 6/1971 | Young | 287/53 |
| 3,965,528 | 6/1976 | Kissler | 16/110 R |
| 4,189,248 | 2/1980 | Sully | 16/118 |
| 4,616,673 | 10/1986 | Bondar | 137/315 |
| 4,766,642 | 8/1988 | Gaffney | 16/121 |
| 4,842,009 | 6/1989 | Reback | 16/121 |
| 4,876,766 | 10/1989 | Cohen | 16/114 R |
| 4,961,443 | 10/1990 | Buccicone et al. | 137/315 |
| 4,984,489 | 1/1991 | Krauthamer | 81/121.1 |
| 5,025,826 | 6/1991 | Schoepe | 16/114 R |

FOREIGN PATENT DOCUMENTS

| | | | |
|---|---|---|---|
| 1516995 | 2/1968 | France | 16/121 |
| 1054302 | 1/1967 | United Kingdom | 16/121 |

OTHER PUBLICATIONS

T-Cranks Replacement Window Cranks brochure.
Truth Specialty Window Hardware brochure.

*Primary Examiner*—Lowell A. Larson
*Assistant Examiner*—Donald M. Gurley
*Attorney, Agent, or Firm*—D. Peter Hochberg; Mark Kusner

[57] ABSTRACT

A casement window low-profile operating apparatus comprises a winged hub having an aperture therein which is adapted to receive any of different size window operator crankshaft adapters. The crankshaft adapters themselves contain an aperture designed to fit the gear of a variety of window operator crankshafts. The handles may conveniently be supplied in the form of a package kit which includes a series of different size adapters, together with the hubs, allowing a correctly sized adapter to be selectively fitted to a particular window. The adapter is installed in the handle and the handle affixed to the crankshaft of the window operator where it can be operated without interfering with window accessories such as curtains, drapes, blinds and the like.

12 Claims, 4 Drawing Sheets

OPERATING APPARATUS FOR CASEMENT WINDOWS

TECHNICAL FIELD

This invention relates to handles for manually operating mechanisms driven by rotatable shafts. More particularly, this invention relates to universal handles adapted to fit the shafts of operating mechanisms employed by casement windows of the types commonly available for sale to the public.

Specifically, this invention relates to handles for casement window operators which can be fitted with any crankshaft adapter of a series thereof each of which adapters is designed to fit the operating shaft of a casement window operator.

BACKGROUND OF THE INVENTION

Casement windows, i.e., those of the type that pivot between their open and closed positions on hinges located on one of their sides, have long enjoyed considerable popularity with the public for a variety of reasons. They are, for example, easy to operate since they are readily opened and closed by means of a generally L-shaped crankshaft handle which rotates the crankshaft of their operating mechanism, whereas two-sash, double-hung windows require considerable effort to slide the sashes past one another in the opening and closing process. Due to the reduced perimeters that must be sealed from the elements, casement windows are also capable of providing superior insulation to structures in which they are installed, compared to double-hung windows.

A disadvantage of casement windows, however, is that most require a window operating mechanism, typically located on the sill of the frame within which the windows are mounted. When so positioned, the operating handle used to operate the mechanism frequently extends beyond the opening in which the window is mounted, thereby interfering with window coverings such as blinds, curtains, drapes and the like, positioned thereover.

To overcome this difficulty the L-shaped, crank handles have often been supplanted by handles having a low-profile, "tee-shaped" configuration since the latter are more compact and do not extend outwardly from the window sufficiently far to interfere with window hangings. Frequently, however, interference of the type described is not discovered until after the crankshaft handles have been installed, necessitating replacement of the handles with those of the tee-type.

While the process of substituting the one type of handle for the other is a relatively simple matter; unfortunately, it has up to now often been difficult to find a tee-shaped handle correctly sized to fit the crankshaft of a particular window operator. In this regard, there are a substantial number of casement window manufacturers, using various window operators, and these have failed to standardize the dimensions of the crankshafts used with their respective window operators. Consequently, it is often difficult to know whether a particular tee-shaped handle being offered for sale is correctly sized to permit replacement of the kind contemplated by this invention.

One method sometimes used to make such a determination prior to actually purchasing a replacement handle involves the use of a sample ring to which are connected a number of representative tee-handles, each being dimensioned to fit a different handle-engagement gear associated with the crankshafts of the more common casement window operators. A would-be purchaser borrows the sample ring from the seller, leaving a security deposit therefore, and checks the window in question at the window's location to determine which of the handles is correct before returning the ring to the store and proceeding with the purchase. The process described is involved, however, and to that extent it is undesirable for both the purchaser and the seller.

A different approach involves the removal of the crank handle to be replaced by the owner thereof, and its matching to one of the sample handle-engagement gears kept at the store of the seller. Again, however, the process involved is one requiring advance preparation before an actual purchase can be made.

BRIEF DESCRIPTION OF THE INVENTION

In view of the preceding, therefore, it is a first aspect of the invention to provide an improved low-profile apparatus for a casement window operator.

A second aspect of the invention is to provide a apparatus for a casement window operator that is easy to install thereon.

Another aspect of this invention is to provide a apparatus for a casement window operator that will not easily strip or break.

An additional aspect of this invention is to provide a apparatus for a casement window operator that avoids interference with window hangings employed in association with casement windows.

A further aspect of this invention is to provide a apparatus for a casement window that can be sized to fit a variety of such windows without the assistance of sizing devices in the possession of third parties.

Yet a further aspect of this invention is to provide a apparatus for a casement window operator that can be modified to fit any of a number of different window operators.

Still another aspect of this invention is to provide a kit containing at least one handle, and a plurality of adapters therefore with which the handle can be combined to make the handle fit a variety of casement window operator crankshafts.

The preceding and still other aspects of the invention are provided by a window operating apparatus comprising in combination a handle member having a central, elongated hub portion with two wing-like flanges extending from either side thereof, opposite each other. The hub portion has a first aperture extending thereinto from a first end thereof. The combination also includes at least one elongated adapter receivable in the first aperture, and non-rotatable therein, the adapter having a second aperture extending therein from a second end thereof, the second aperture being adapted to grip the crankshaft of a casement window operator therein. When the adapter is inserted into the first aperture, the crankshaft can be inserted in the second aperture and rotated by turning the handle.

The preceding and further aspects of the invention are provided by a universal casement window operator handle kit comprising:

(a) at least one handle member according to the preceding paragraph;

(b) a plurality of adapters according to the preceding paragraph, at least some of which are dimensioned to receive different size crankshafts of casement window operators, and (c) a container suitable for holding (a) and (b).

The preceding and other aspects of the invention are provided by a casement window operator apparatus comprising in combination a handle member having a central, elongated hub portion with two wing-like flanges extending from either side thereof, opposite each other. The hub portion has a first or hub aperture extending thereinto from a first end thereof, such aperture being provided with shoulder means at the first end. Included in the combination are at least one elongated adapter receivable in the first aperture, the adapter having a second or adapter aperture extending thereinto from a second end thereof. The exterior perimeter of a transverse cross-section of the adapter and the interior perimeter of a counterpart transverse cross-section of the first aperture in the hub portion have substantially similar polygonal shapes. The second aperture is provided with a plurality of elongated splines extending from its interior surface positioned parallel to the longitudinal axis of the adapter, the second aperture being thereby adapted to grip the crankshaft of a casement window operator therein. When the adapter is inserted into the first aperture, the crankshaft can be inserted into the second aperture and rotated by turning the handle.

The preceding and still further aspects of the invention are provided by a casement window fitted with an operating handle the type described in the preceding paragraphs.

BRIEF DESCRIPTION OF THE DRAWINGS

The invention will be better understood when reference is had to the following drawings in which like-numbers refer to like-parts, and in which.

DETAILED DESCRIPTION OF THE INVENTION

Figure 1:
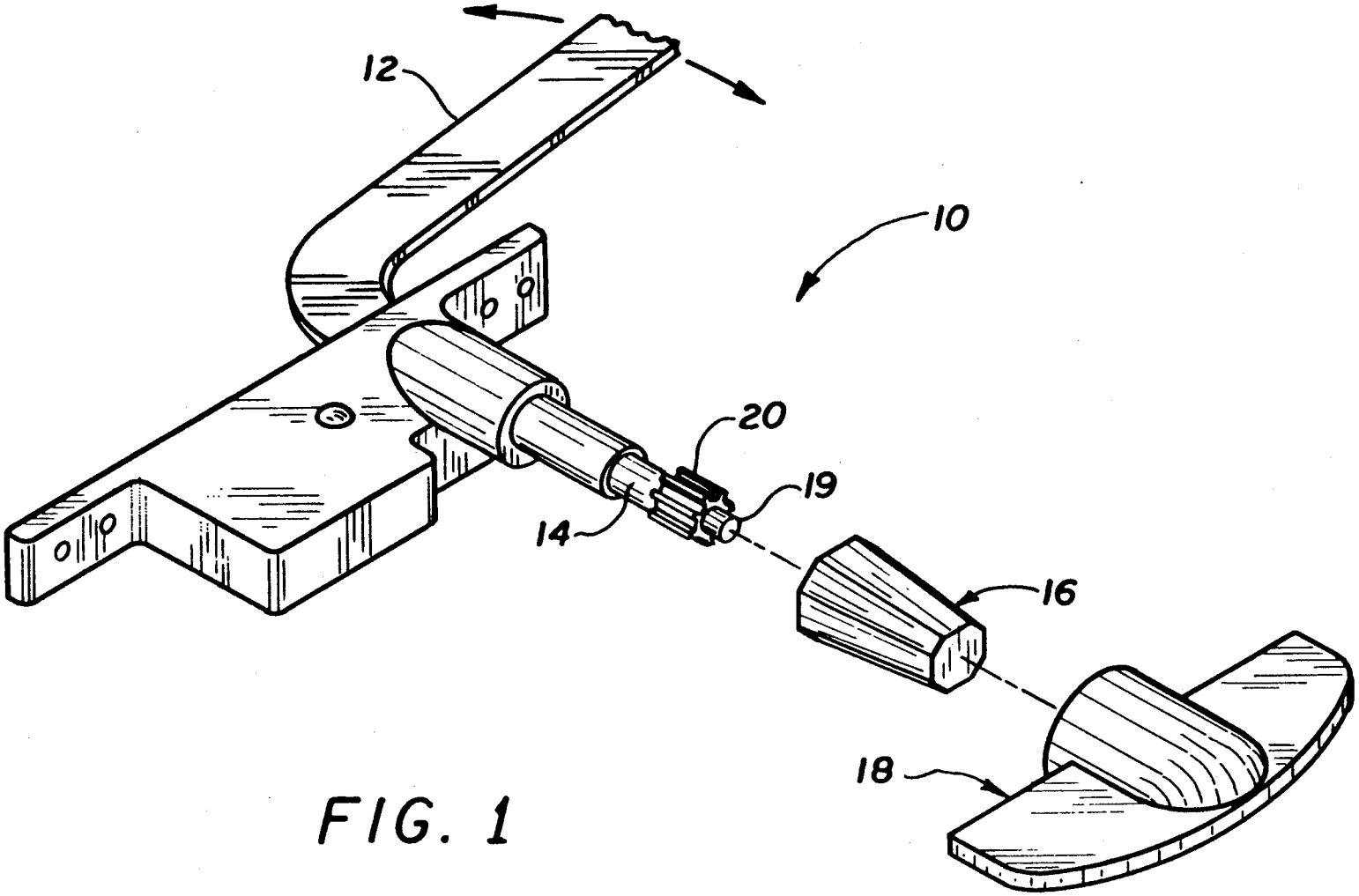
FIG. 1 is an exploded, isometric view of a handle and adapter combination of the invention in association with a casement window operator.

FIG. 1 is an exploded isometric view of a handle and adapter of the invention in association with a casement window operator. As shown, a casement window operator, generally 10, comprises a window operator crankshaft 14, which when rotated, operates a mechanism, not shown, causing window lever arm 12 to pivot inwardly or outwardly in the direction of the associated arrows, closing or opening a window, not shown. The crankshaft 14 is provided with a crankshaft handle-engagement gear 20, and in some cases, but not in all, it includes a crankshaft end portion 19 extending beyond the gear. Also shown is a crankshaft adapter 16 designed for insertion over crankshaft 14, allowing the adapter to grippingly engage handle-engagement gear 20 by spline means, for example, better seen in connection with FIGS. 3 and 3A. A crankshaft operating handle 18 is also illustrated, being adapted to fit over adapter 16, the two components being non-rotatable with respect to each other, thereby allowing the window operator crankshaft 14 to be rotated when handle 18 is rotated, in turn pivoting of the window lever arm 12.

To make the substitution of handles previously described, the original crank handle is removed from crankshaft 14, typically by loosening a set screw that holds the handle thereon. Thereafter, various size adapters are fitted to the window by placing them separately onto the crankshaft until one is found which slips on easily, but grippingly. The adapter is then rotated with the fingers to confirm that the window lever arm 12 can be operated thereby. After the properly dimensioned adapter has been determined, the crankshaft operating handle 18 is slipped over the adapter 16 until a firm engagement is achieved. In a final step, the handle 18 with the crankshaft adapter 16 therein is pressed firmly onto the window crankshaft 14, completing the assembly.

Figure 2:
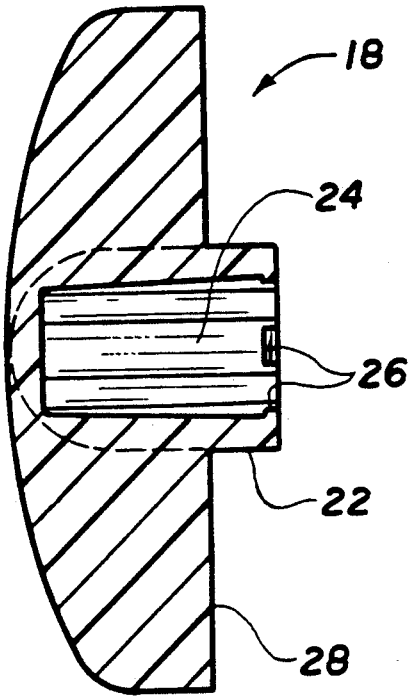
FIG. 2 is a cross-section of a side elevation of the crankshaft operating handle of the invention along line 2—2 of FIG. 2A.
Figure 2A:
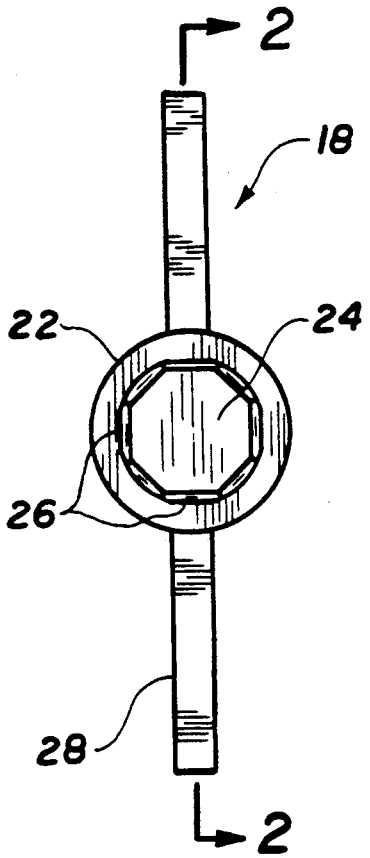
FIG. 2A is a front view of a crankshaft operating handle of the invention.

FIG. 2 is a cross-section of a side elevation of the crankshaft operating handle of the invention along line 2—2 of FIG. 2A. Shown in the Figure is the crankshaft operating handle, generally 18, comprising wing-like flanges 28 extending from either side of a handle hub 22, opposite each other. The handle hub 22 has a cavity or aperture 24 extending thereinto from one end thereof, and in a preferred embodiment, the opening into the aperture is provided with an annular locking shoulder 26 which serves the purpose of preventing disengagement of an adapter 16 inserted therein.

The dimensions of the handle may vary; however, the length of the handle as measured from wing tip to wing tip will advantageously be about 2½ inches, while the length of the handle hub will be about 1 inch. In such case, the depth of the aperture 24 will be about ⅞ inch, the aperture will typically have an opening or "throat" of about ½ inch, and the outside diameter at the hub at that point will be about ¾ inch. The locking shoulder will advantageously extend from the side of the aperture towards the center thereof for a distance of about 0.01 inches.

FIG. 2A is a front view of a crankshaft operating handle of the invention. In the Figure can be seen the handle wings 28 extending from opposite sides of the handle hub 22. The handle aperture 24 can be seen in the Figure to be configured in an octagonal shape, designed to receive an adapter configured as indicated in FIG. 3A. The multi-walled shape of the aperture 24 prevents the rotation of an adapter 16 in the aperture, allowing the handle to be turned to operate the crankshaft 14.

The use of plastics for casement window operator handles of the type contemplated by the invention is preferred over metal handles since plastics are in many respects more durable than metal handles, and since they have a degree of elasticity which allows the adapters to be securely inserted therein and the adapter to be snugly fitted onto the window operator crankshafts even in the absence of a set screw. Inasmuch as force must be transmitted through the crankshaft operator handle 18 to the window operator crankshaft 14, and furthermore to avoid having the gear-engaging splines in the interior of adapter 16, better seen in FIG. 3, stripped or otherwise damaged, it has been found desirable to fabricate the crankshaft operating handle 18 and the adapter 16 from an engineering-type plastic such as ABS, acetal resins, acrylic resins, fluorocarbons, Nylon and the like. The use of acetal-type resins is particularly preferred, however, for example, a Celcon resin, i.e., a highly crystalline acetal copolymer based on trioxane, manufactured by the Celanese Chemical Company.

Pigments can be incorporated into the plastics to provide the handles with any color desired, avoiding the risk that surface damage will alter the appearance of the handles, which can take place, in the case of painted handles, for example, when the paint is chipped.

Figure 3:
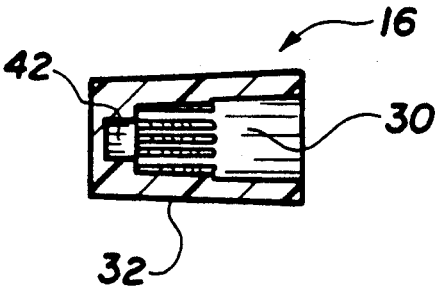
FIG. 3 is a cross-section of a side elevation of one of the crankshaft adapters of the invention along line 3—3 of FIG. 3A.
Figure 3A:
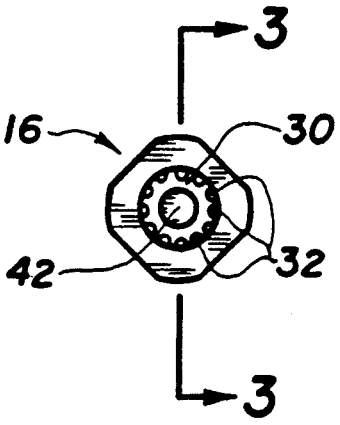
FIG. 3A is a front view of a crankshaft adapter of the invention.

FIG. 3 is a cross-section of a side elevation of one of the crankshaft adapters of the invention along line 3—3 of FIG. 3A. In the Figure, the interior of the crankshaft adapter 16 can be seen to include an aperture 30 that is provided with engagement splines 32 which provide secure engagement with crankshaft handle-engagement gear 20. A recess 42 for the end portion of the crankshaft is also present, for instance, to accommodate a window operator crankshaft of the type shown as 14, where the handle-engagement gear is not located on the end of the crankshaft.

The dimensions of the adapter will naturally depend upon those of the handle aperture 24; however, in the case of the dimensions described in connection with crankshaft operating handle 18, the length of the adapter will be about ¾ inch and its outside diameter at the open end will be about ¾ inch. The opening into aperture 30 will vary, depending upon the window operator crankshaft to be accommodated.

FIG. 3A is a front view of a crankshaft adapter of the invention 16 showing the elongated splines 32 extending from the interior surface of the aperture, and positioned parallel to the longitudinal axis of the adapter. Also seen is the recess 42 for the end portion of the crankshaft 14. While the exterior perimeter of the transverse cross-section of the adapter is shown as octagonal, any multi-wall configuration would be suitable, as would any non-circular exterior, since any of them would prevent the rotation of the crankshaft operating handle 18, relative to the adapter 16.

Figure 4:
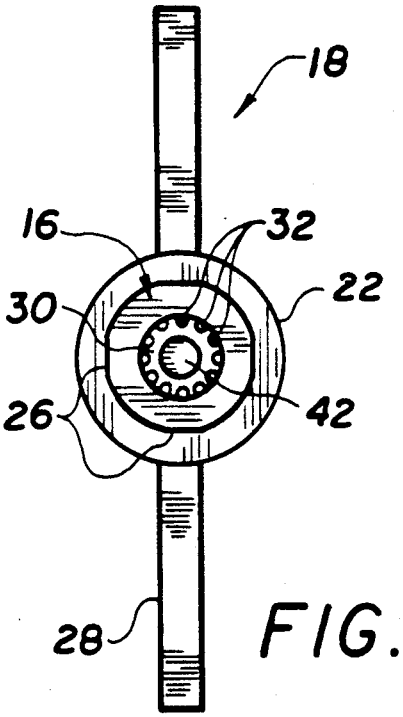
FIG. 4 is a front view of a crankshaft operating handle of the invention in which a crankshaft adapter has been inserted.

FIG. 4 is a front view of a crankshaft operating handle of the invention in which a crankshaft adapter has been inserted. In the case of the Figure, the crankshaft operating handle 18 is illustrated, with its extending wings 28 attached to opposite sides thereof, and into which has been inserted a crankshaft adapter 16. The engagement splines 32 can be seen extending from the interior surface of the adapter 16, and the recess 42 for a crankshaft end portion can be observed located at one end of the adapter aperture 30. To facilitate insertion of the adapter 16 in the crankshaft operating handle 18, it is desirable to provide a taper to the adapter. In this regard, the aperture of the crankshaft operating handle 18 tapers downwardly from the entrance, or throat of the aperture to its interior end. In similar fashion, the exterior surface of the open end of the crankshaft adapter 16 tapers downwardly towards its closed end, the taper of the adapter substantially corresponding to that of the aperture in the handle hub 22, and their counterpart transverse cross-sections at any given point along their lengths being complementary to each other, thereby assuring that the adapter can be inserted into the aperture of the handle hub. Commonly, the taper of the components described will be from about 1°-2°, a taper of about 1° being preferred, althrough other tapers could also be useful.

Figure 5:
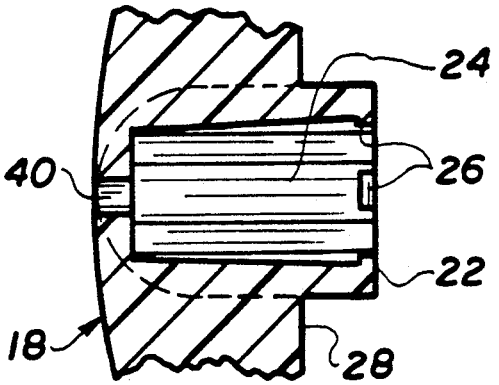
FIG. 5 is a cross-sectional, partial view of a handle of the invention viewed in the same direction as that shown by line 2—2 of FIG. 2A.

FIG. 5 is a cross-sectional partial view of a handle of the invention viewed in a direction the same as that shown by line 2—2 of FIG. 2A. In the Figure, portions of the wings 28 can be seen extending from opposite sides of the handle hub 22. The aperature 24 shown is provided with an access hole 40 which communicates between the exterior rear-end of the crankshaft operating handle 18 and its interior aperture 24. Acess hole 40 represents a further embodiment of the invention which provides a way in which a crankshaft adapter 16 may be removed from the handle hub 22 in those instances in which it is desired to replace the adapter for any reason, for example, when a different sized adapter is desired. Removal may then be accomplished by inserting any type of rod-like tool into the access hole and forcing the open end of the adapter past locking shoulder 26 until it can be grasped and removed.

The crankshaft adapters and crankshaft operating handles may be fabricated in any of the ways normally used to make small plastic components, for instance, by molding, by injection molding, and in other ways well known in the art.

Figure 6:
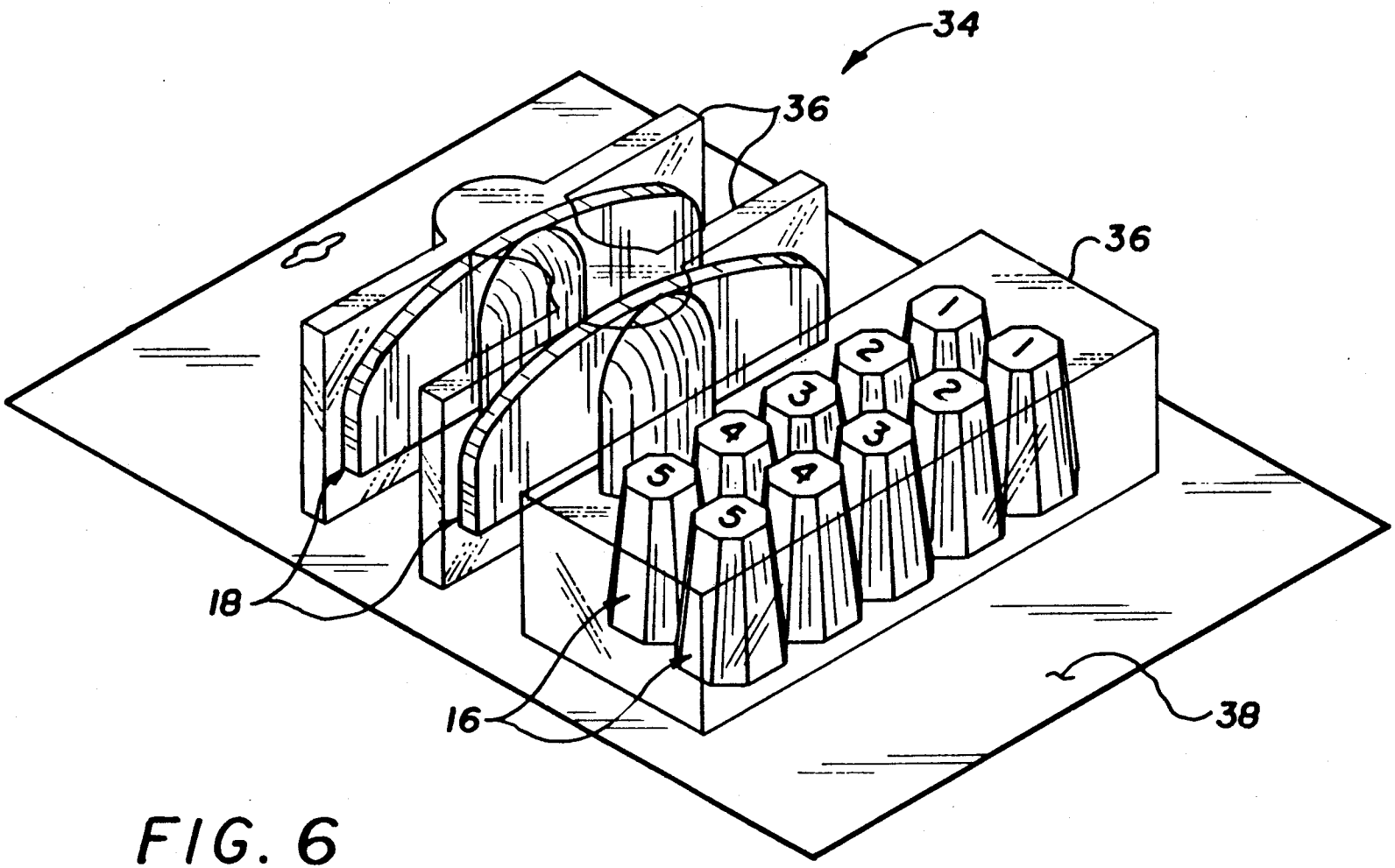
FIG. 6 is an isometric view of a kit containing crankshaft operating handles and crankshaft adapters of the invention.

FIG. 6 is an isometric view of a kit containing crankshaft operating handles and crankshaft adapters of the invention. Illustrated in the Figure are two c crankshaft operating handles 18, as well as a series of different sized crankshaft adapters 16. The components of the kit 34 may be enclosed in a transparent "blister" cover mounted on a display card 38 which desirably has instructions for using the casement window operator printed thereon. They may also be sold in bulk, for example, packaged loosely in heat-sealed bags. In the Figure, a number of crankshaft adapters are included, for example, those having aperature diameters of 9/32", 10/32", 11/32", 12/32", or other sizes. If desired, adapters having splines of different lengths or splines occupying different positions within the aperture, and with or without recesses for crankshaft end portions may be included.

As shown in the Figure, it is often of advantage to imprint a number on the end of the adapters to assist in the process of fitting them to the window operator crankshaft.

While in accordance with the patent statutes, a preferred embodiment and best mode has been presented, the scope of the invention is not limited thereto, but rather is measured by the scope of the attached claims.

What is claimed is:

1. A window operating apparatus for operating the crankshaft of a casement window operator, said apparatus comprising:

a handle member having a central, smooth, cylindrical elongated hub portion which is symmetrical about a longitudinal axis and two solid, planar wing-like flanges extending from opposite sides of said hub portion, said flanges being coplanar to each other and with said longitudinal axis, said hub portion having a hub aperture extending thereinto from an end thereof, said hub aperture having a closed end, an opened end and an inner surface of predetermined configuration, inward extending shoulder means on said hub portion at the opened end of said hub aperture, an adapter with an outer surface dimensioned to mate with said inner surface of said hub aperture, said adapter being receivable in said hub aperture of said hub portion and non-rotatable therein, said adapter dimensioned to be retained completely within said hub aperture and to be confined therein by said shoulder means, said adapter having a longitudinal axis and an adapter aperture extending into said adapter from an end thereof, and a plurality of elongated splines extending from the interior surface of said adapter aperture, said splines being generally to the longitudinal axis of said adapter and dimensioned to matingly engage the crankshaft of a casement window operator whereby when said adapter is inserted in said hub aperture, said crankshaft can be inserted in said adapter aperture and rotated by turning said handle member.

2. Apparatus according to claim 1, which includes a plurality of said adapters, the adapter aperture of each of which is dimensioned to receive a different size said crankshaft.

3. Apparatus according to claim 1 wherein the exterior perimeters of a transverse cross-section of said adapter, and the interior perimeter of a counterpart transverse cross-section of said hub aperture in said hub portion are substantially complementary.

4. Apparatus according to claim 1 wherein the external surface of said adapter and the internal surface of said hub aperture are tapered downwardly substantially to the same degree along their longitudinal axis in the direction away from the open ends of said apertures.

5. Apparatus according to claim 4 in which said taper is about 1 degree.

6. Apparatus according to claim 1 wherein said handle member and said adapters are fabricated from an acetal-type resin.

7. Apparatus according to claim 1 in which said adapter aperture includes means for engaging said crankshaft to prevent its rotation relative to said adapter.

8. Apparatus according to claim 7 in which said adapter aperture includes a longitudinal axis, and said means comprises a plurality of elongated splines extending from the surface of said adapter aperture, parallel to the longitudinal axis of said adapter.

9. A universal casement window operator device comprising:

(a) at least one handle member according to claim 1;

(b) a plurality of adapters according to claim 1, at least some of which are dimensioned to receive different size crankshafts of casement window operators, and (c) a package container suitable for holding (a) and (b).

10. A casement window operator apparatus comprising:

a handle member having a central, elongated hub portion with two wing-like flanges extending from opposite sides thereof, said hub portion having a hub aperture extending thereinto from a first end thereof, said hub aperture including an opened end, a closed end and an inward projecting shoulder means at said opened end;

at least one elongated adapter dimensioned to be received within said hub aperture and to be totally confined therein by said shoulder means, said adapter having a longitudinal axis and an adapter aperture extending into said adapter from an end thereof, wherein the exterior perimeter of a transverse cross-section of said adapter and the interior perimeter of a counterpart transverse cross-section of said hub aperture have substantially similar polygonal shapes, and a plurality of elongated splines extending from an interior surface of said adapter aperture, said splines being generally parallel to the longitudinal axis of said adapter and dimensioned to matingly engage splines on a crankshaft of a casement window operator, whereby when said adapter is inserted in said hub aperture, said crankshaft can be inserted in said adapter aperture and rotated by turning said handle member.

11. Apparatus according to claim 10 wherein the external surface of said adapter and the internal surface of said hub aperture are tapered downwardly substantially to the same degree along their longitudinal axis in the direction away from open ends of said apertures.

12. A window operating apparatus for operating the crankshaft of a casement window operator, said apparatus comprising:

a handle member having an elongated, smooth, cylindrical central hub portion which is symmetrical about a longitudinal axis, and two flat, solid, planar wing-like flanges extending from opposite sides of said hub portion, said hub portion having a hub aperture extending thereinto from an end thereof, said hub aperture having a closed end, an opened end, and an inner surface of predetermined configuration, inward extending shoulder means on said hub portion at the opened end of said hub aperture, an adapter with an outer surface dimensioned to mate with said inner surface of said hub aperture, said adapter being receivable in said hub aperture of said hub portion and non-rotatable therein, said adapter dimensioned to be retained within said hub aperture and to be confined therein by said shoulder means, said adapter having a longitudinal axis and an adapter aperture extending into said adapter from an end thereof, a plurality of elongated splines extending from the interior surface of said adapter aperture, said splines being generally parallel to the longitudinal axis of said adapter, and dimensioned to matingly receive splines on the crankshaft of a casement window operator, and an opening in said hub portion extending through said closed end into said hub aperture.

* * * * *